US005498999A

United States Patent [19]

Marusawa et al.

[11] Patent Number: 5,498,999

[45] Date of Patent: Mar. 12, 1996

[54] HIGH-FREQUENCY USE NON-RECIPROCAL CIRCUIT ELEMENT

[75] Inventors: Hiroshi Marusawa; Takashi Kawanami; Takehiro Konoike; Kunisaburo Tomono, all of Nagaokakyo, Japan

[73] Assignee: Murata Manufacturing Co., Ltd., Japan

[21] Appl. No.: 320,675

[22] Filed: Oct. 11, 1994

[30] Foreign Application Priority Data

Oct. 12, 1993 [JP] Japan ..... 5-254490

[51] Int. Cl.[6] ..... H01P 1/387

[52] U.S. Cl. ..... 333/1.1; 333/24.2; 156/89; 264/61

[58] Field of Search ..... 333/1.1, 24.1, 333/24.2

[56] References Cited

U.S. PATENT DOCUMENTS 5,017,894 5/1991 Naito ..... 333/1.1

5,379,004 1/1995 Marusawa et al. ..... 333/1.1

FOREIGN PATENT DOCUMENTS 299904 11/1993 Japan ..... 333/1.1

*Primary Examiner*—Paul Gensler

*Attorney, Agent, or Firm*—Ostrolenk, Faber, Gerb & Soffen

[57] ABSTRACT

A high-frequency use non-reciprocal circuit includes a sintered body which is a high-frequency use magnetic body obtained by a ceramic lamination/integral firing technique, a plurality of central electrodes which are arranged in the sintered body to be separated from each other through a magnetic layer while intersecting with each other at central portions, and electrodes for deriving impedance-matching capacitance which are formed in the vicinity of the intersecting portion to be in series with the central electrodes. The magnetic layer provided between the central electrodes serves as an insulating layer for electrically insulating the central electrodes from each other, a high-frequency use magnetic layer, and a material layer for deriving the impedance-matching capacitance.

8 Claims, 8 Drawing Sheets

HIGH-FREQUENCY USE NON-RECIPROCAL CIRCUIT ELEMENT

BACKGROUND OF THE INVENTION

1. Field of the Invention

The present invention relates to a non-reciprocal circuit element which is for use in a high frequency band of about 0.5 to 3 GHz, for example, and more particularly, it relates to a high-frequency use non-reciprocal circuit element which is integrally provided with impedance-matching capacitance. The high-frequency use non-reciprocal circuit element according to the present invention may be a lumped parameter circulator or isolator, for example.

2. Description of the Background Art

Integration of high-frequency circuits has recently progressed in relation to mobile communication systems and the like, and hence miniaturization, cost reduction and improvement in reliability are required for a non-reciprocal circuit element which is employed for such an integrated circuit.

The non-reciprocal circuit element, such as a lumped parameter circulator or isolator, for example, comprises a plurality of central electrodes which are electrically insulated from each other by an insulator layer and arranged to intersect with each other, a high-frequency use magnetic body which is arranged on an intersectional portion of the central electrodes, and a permanent magnet for applying a dc magnetic field to the intersectional portion, with formation of impedance-matching capacitance, for example.

FIG. 6 is a perspective view for illustrating an exemplary step of assembling a conventional high-frequency use non-reciprocal circuit element. In order to assemble the high-frequency use non-reciprocal circuit element, a central electrode 124*a* of metal foil such as Cu foil, for example, is first arranged on a discoidal high-frequency use magnetic body 123*a*.

The central electrode 124*a* radially extends along an upper surface of the high-frequency use magnetic body 123*a* through its center, to reach side surfaces of the magnetic body 123*a*.

Then, an insulating film 125*a* of an insulating material is arranged on the central electrode 124*a*, and another central electrode 124*b* is arranged thereon to intersect with the central electrode 124*a*. Further, another insulating film 125*b*, still another central electrode 124*c* and still another insulating film 125*c* are successively stacked on the central electrode 124*b*, and a high-frequency use magnetic body 123*b* is stacked on the uppermost portion.

The high-frequency use non-reciprocal circuit element which is assembled in the aforementioned manner is combined with a permanent magnet, yokes holding the permanent magnet and other conventional components to form a circulator or an isolator, as shown in FIG. 7 in an exploded perspective view.

Referring to FIG. 7, a rectangular substrate 131 of an insulating material such as alumina is provided in its center with a through hole 131*a* for receiving the aforementioned high-frequency use non-reciprocal circuit element. Electrodes 132 for deriving capacitance are formed on an upper surface of the substrate 131 by printing conductive films.

On the other hand, an earth electrode is formed on a lower surface of the substrate 131, to be opposed to the capacitance deriving electrodes 132 through the substrate 131. An earth plate 133 illustrated in a lower portion is bonded to this earth electrode by soldering, to be integrated with the substrate 131. The earth plate 133 is formed by a metal plate, and provided with a through hole 133*a* in its center and uprights 133*b* in portions facing the through hole 133*a*. When the substrate 131 and the earth plate 133 are bonded to each other as described above, the uprights 133*b* upwardly project from the through hole 131*a* of the substrate 131.

As clearly understood from FIG. 8 showing a principal part of the assembly as formed, the uprights 133*b* are soldered to first ends of the central electrodes 124*a* to 124*c* of the aforementioned high-frequency use non-reciprocal circuit element respectively by soldering or the like. Referring to FIG. 8, the insulating films 125*a* to 125*c* are omitted, while numeral 137 denotes the earth electrode which is formed on the lower surface of the substrate 131. The capacitance deriving electrodes 132, the substrate 131 and the earth electrode 137 provided on the back surface of the substrate 131 form impedance-matching capacitance.

On the other hand, second ends of the central electrodes 124*a* to 124*c* of the high-frequency non-reciprocal circuit element are electrically connected to the capacitance deriving electrodes 132 which are formed on the upper surface of the substrate 131 respectively, as understood from the central electrode 124*c* typically shown in FIG. 8, for example.

Referring again to FIG. 7, the substrate 131 and the earth plate 133 are stacked with each other and the high-frequency use non-reciprocal circuit element is integrated into the through holes 131*a* and 133*b*, and the laminate as formed is held by yokes 134 and 135 from upper and lower portions, thereby forming a high-frequency use non-reciprocal circuit device. A permanent magnet 136 is fixed to a lower surface of the yoke 134. The yokes 134 and 135, which are made of a metal, have pairs of opposite ends which are bent toward each other, to be fixed to each other through the bent portions by soldering or mechanical engagement. Therefore, the yokes 134 and 135 and the permanent magnet 136 form a closed magnetic circuit for applying a dc magnetic field to the central electrodes 124*a* to 124*c*.

As described above, the conventional high-frequency use non-reciprocal circuit element requires a complicated manual operation for assembling the structure shown in FIG. 8, as well as soldering and a complicated manual operation for connecting the permanent magnet for applying a dc magnetic field and the earth electrode.

In the conventional high-frequency use non-reciprocal circuit element, as hereinabove described, insulating resin films or resin tapes are interposed between the central electrodes, or insulating substrates having central electrodes printed thereon are pasted to each other, in order to electrically insulate the central electrodes from each other. Further, the aforementioned insulating films and the insulating substrate are generally successively assembled by a manual operation. In addition, it is generally necessary to add capacitance to the high-frequency use non-reciprocal circuit element for impedance matching. Such capacitance for an impedance-matching circuit is added by connecting a separately prepared capacitor, or by forming a capacitor through an insulating substrate and combining the same with the high-frequency use non-reciprocal circuit as described above, also by a manual operation.

With progress in miniaturization and generalization of the high-frequency use non-reciprocal circuit element, however, its dimensions are now being reduced to millimeters. Thus, it is extremely difficult to manually assemble such a small element, such that imperfect assembling is frequently caused by misregistration between central electrodes and capacitance for an impedance-matching circuit, leading to reduction in reliability.

In the conventional high-frequency use non-reciprocal circuit element, as described above, it is necessary to manually assemble not only the principal part which is provided with a plurality of central electrodes and a high-frequency use magnetic body but also a capacitor for forming additional capacitance for impedance matching through complicated manual operations, and the number of components is greatly increased, leading to a great increase in cost.

SUMMARY OF THE INVENTION

An object of the present invention is to provide a high-frequency use non-reciprocal circuit element comprising central electrodes intersecting with each other in a state electrically insulated from each other and impedance-matching capacitance integrally provided with the same, which can be extremely easily manufactured through no complicated manual operations, is easy to miniaturize, and provided with high reliability.

According to a broad aspect of the present invention, provided is a high-frequency use non-reciprocal circuit element comprising at least one insulator layer, a plurality of central electrodes which are separated through the insulator layer to be electrically insulated from each other and arranged to intersect with each other, a high-frequency use magnetic body which is arranged at an intersectional portion of the central electrodes, and impedance-matching capacitance which is connected to the central electrodes. A dc magnetic field is applied to the intersectional portion by a permanent magnet, while the insulator layer and a dielectric portion for the impedance-matching capacitance are integrally formed by the same material layer as the high-frequency use magnetic body. The high-frequency use non-reciprocal circuit element further comprises at least a pair of electrodes for deriving the impedance-matching capacitance.

In the high-frequency use non-reciprocal circuit element according to the present invention, the insulator layer and impedance-matching capacitance deriving members are integrally formed by the same material layer as the high-frequency use magnetic body. Therefore, a principal part including the central electrodes and portions forming the impedance-matching capacitance can be assembled through no complicated manual operation. Further, the portions for electrically insulating both the plurality of central electrodes from each other and the impedance-matching capacitance are formed by the same material layer, whereby the number of the components can be remarkably reduced.

In the non-reciprocal circuit element according to the present invention, the plurality of central electrodes are preferably formed in the high-frequency use magnetic body in the form of internal electrodes through a ceramic lamination/integral firing technique. In this case, little or no relative misregistration between the central electrodes is caused, so that reliability of the non-reciprocal circuit element can be effectively improved, and also miniaturization thereof is facilitated.

The high-frequency use magnetic body is generally made of ferrite, which has relatively small dielectric loss. Thus, it is possible to form impedance-matching capacitance having a high Q factor by employing ferrite as the material for the high-frequency use magnetic body.

According to the present invention, the plurality of central electrodes are formed in a state electrically insulated from each other through the same material layer as the high-frequency use magnetic body. When the plurality of central electrodes are formed in the high-frequency use magnetic body through the ceramic lamination/integral firing technique, therefore, the plurality of central electrodes are formed in different vertical positions in the magnetic body.

According to the present invention, two or more central electrodes may be formed on each of the different vertical positions.

According to the present invention, further, an earth electrode may be formed on a position which is separated from the central electrodes and the impedance-matching capacitance deriving electrodes,through the high-frequency use magnetic layer.

In addition, the aforementioned electrodes for deriving the impedance-matching capacitance are preferably formed in the vicinity of the intersectional portion of the central electrodes in series with at least a pair of central electrodes. When the electrodes for deriving the impedance-matching capacitance are thus formed in series with the central electrodes, it is possible to form the impedance-matching capacitance through line capacities between the plurality of central electrodes, thereby reducing the cost of the material for the impedance-matching capacitance deriving electrodes. Thus, it is possible to further miniaturize the high-frequency use non-reciprocal circuit element and reduce the cost therefor.

Alternatively, the electrodes for deriving the impedance-matching capacitance may not be formed in series with the central electrodes.

According to the present invention, as hereinabove described, it is possible to provide a miniature high-frequency use non-reciprocal circuit element having excellent reliability at a low cost.

The foregoing and other objects, features, aspects and advantages of the present invention will become more apparent from the following detailed description of embodiments of the present invention when taken in conjunction with the accompanying drawings.

DESCRIPTION OF THE PREFERRED EMBODIMENTS

Embodiments of the high-frequency use non-reciprocal circuit element according to the present invention are now described with reference to the drawings, to clarify the present invention. In the following description, methods of manufacturing high-frequency use non-reciprocal circuit elements according to the embodiments are described first to clarify the structures of the inventive high-frequency use non-reciprocal circuit elements.

First Embodiment

Magnetic mixed powder containing yttrium oxide ($Y_2O_3$) and iron oxide ($Fe_2O_3$) in a weight ratio of 46:54 is calcined at a temperature of 800° to 1200° C., to prepare calcined powder employed for a high-frequency use magnetic body.

The calcined powder is crushed and dispersed in an organic solvent with a polyvinyl alcohol binder, to prepare a magnetic slurry. The magnetic slurry as obtained is employed to form a magnetic green sheet having a uniform thickness of several 10 μm by a doctor blade coater, and this magnetic green sheet is punched into a strip having a rectangular plane shape of 40 mm by 20 mm.

Figure 1:
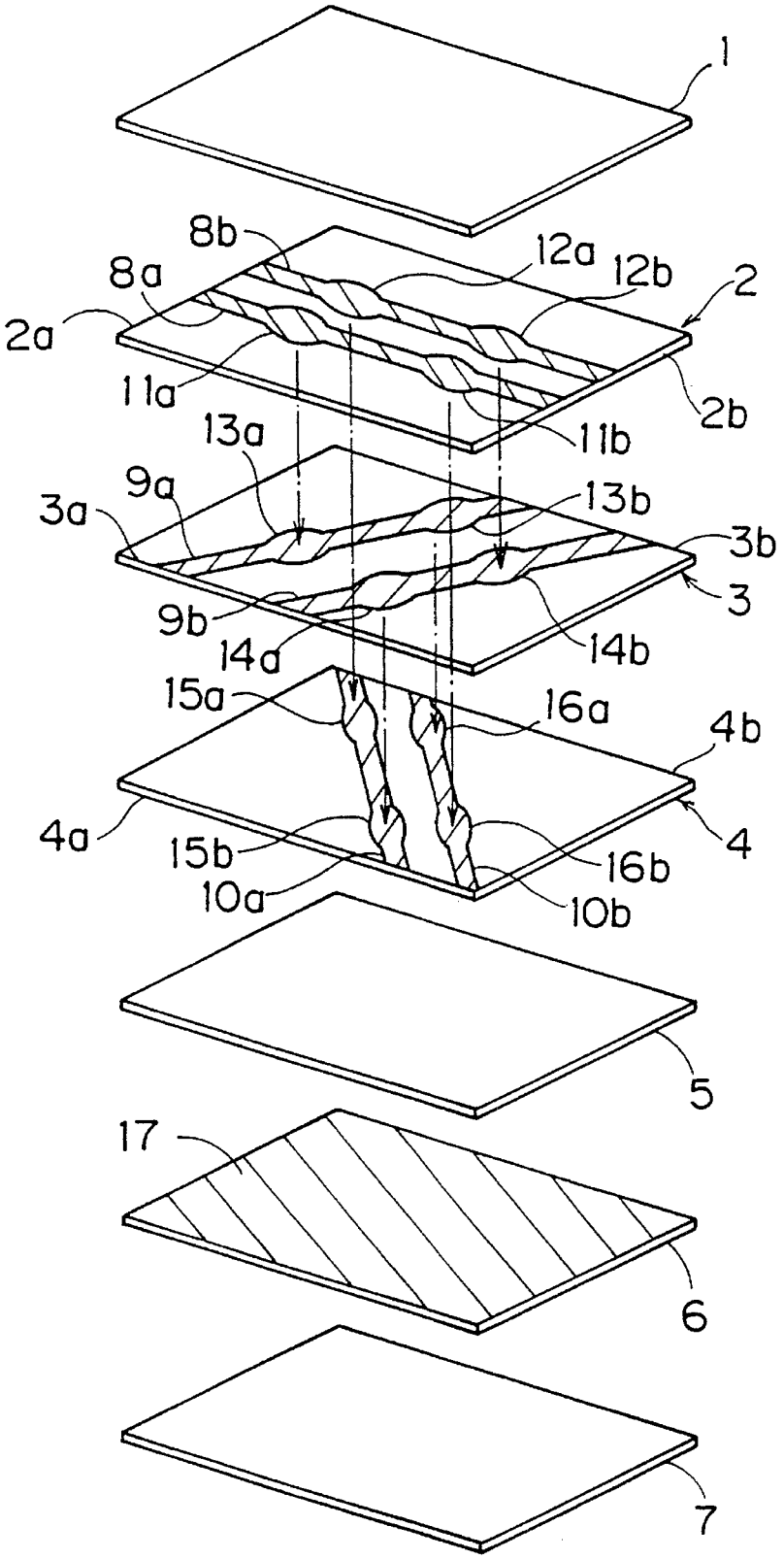
FIG. 1 is an exploded perspective view for illustrating magnetic green sheets employed for obtaining a high-frequency use non-reciprocal circuit element according to a first embodiment of the present invention and shapes of electrodes which are formed thereon.

A plurality of such punched magnetic green sheets are prepared so that conductive paste is screen-printed on single surfaces of parts of these green sheets as shown in FIG. 1, thereby forming central electrodes and capacitance deriving electrodes which are in series with the central electrodes.

In more concrete terms, a plurality of magnetic green sheets 1 to 7 are prepared in FIG. 1. A plurality of central electrodes 8*a* and 8*b* are formed on an upper surface of the magnetic green sheet 2, to extend from one edge 2*a* to another edge 2*b*. Conductive paste is printed on upper surfaces of the magnetic green sheets 3 and 4, to form central electrodes 9*a*, 9*b*, 10*a* and 10*b* extending across side edges 3*a*, 3*b*, 4*a* and 4*b* respectively.

In each of the central electrodes 8*a* to 10*b*, the conductive paste is increased in width in two portions, thereby forming electrodes 11*a* and 11*b* to 16*a* and 16*b* for deriving capacitance for an impedance-matching circuit.

Figure 2A:
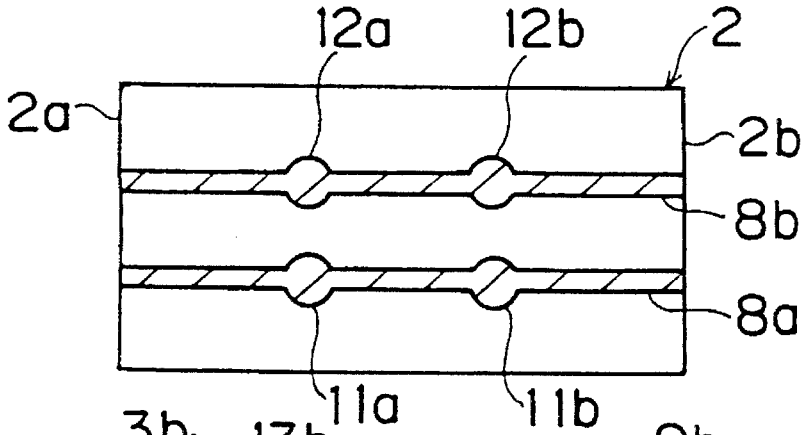
FIGS. 2A to 2C are plan views for illustrating shapes of central electrodes which are printed on some of the magnetic green sheets shown in FIG. 1.
Figure 2B:
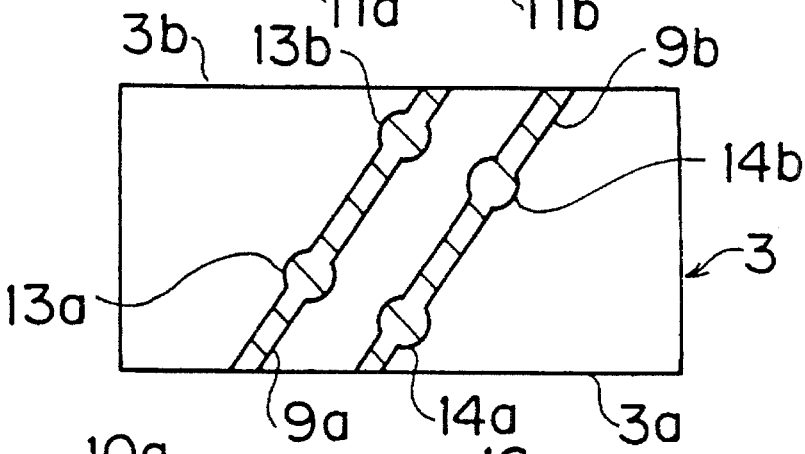
Figure 2C:
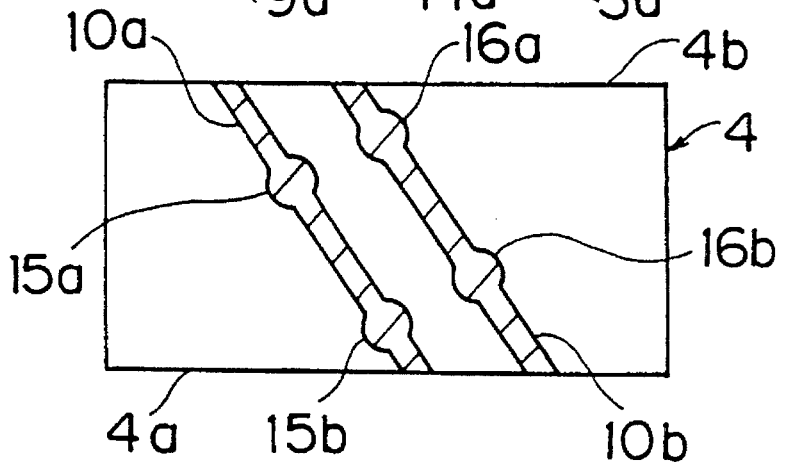

The central electrodes 8*a* and 8*b* to 10*a* and 10*b* extend in directions shown in FIGS. 2A to 2C in plan views respectively, to intersect with each other at central portions in a laminate which is formed by stacking the magnetic green sheets 1 to 7 with each other as described later, while being separated from each other by the magnetic green sheets 2 and 3.

As clearly understood from FIGS. 1 and 2A to 2C, the electrodes 11*a* to 16*b* for deriving the capacitance for an impedance-matching circuit are so arranged that pairs of these electrodes overlap with each other through the magnetic green sheets 2 and 3 respectively. For example, the electrode 11*a* is arranged to overlap with the electrode 13*a* through the magnetic green sheet 2, while the electrodes 12*a* and 15*a* are arranged to overlap with each other through the magnetic green sheets 2 and 3.

In other words, the capacitance deriving electrodes 11*a* to 16*b* are so formed as to derive capacitance which is based on one or two magnetic green sheets between each pair of overlapping capacitance deriving electrodes. According to this embodiment, therefore, the magnetic green sheets 2 and 3 which are adapted to electrically insulate the plurality of central electrodes 8*a* and 8*b* to 10*a* and 10*b* from each other and to arrange a high-frequency use magnetic body on an intersectional portion of the central electrodes 8*a* to 10*b* also serve as materials for forming the capacitance for an impedance-matching circuit. In other words, the magnetic green sheets 2 and 3 function as material layers having three functions for serving as the inventive insulating layers, high-frequency use magnetic layers and material layers for deriving the capacitance for an impedance-matching circuit in a sintered body which is obtained by firing a laminate prepared by stacking the magnetic green sheets 1 to 7 as described later.

Then, conductive paste is screen-printed on the overall upper surface of the magnetic green sheet 6 as shown in FIG. 1, to form an earth electrode 17. The magnetic green sheets 1, 5 and 7 are provided with no electrodes.

Then, the magnetic green sheets 1 to 7 shown in FIG. 1 are stacked with each other in the illustrated direction, and the laminate as obtained is pressurized along its thickness so that the magnetic green sheets 1 to 7 are compression-bonded to each other. Then, the laminate is fired at a temperature of 1450° to 1550° C. so that the magnetic green sheets 1 to 7 are integrally fired with the aforementioned electrode materials, thereby obtaining a sintered body.

Figure 3:
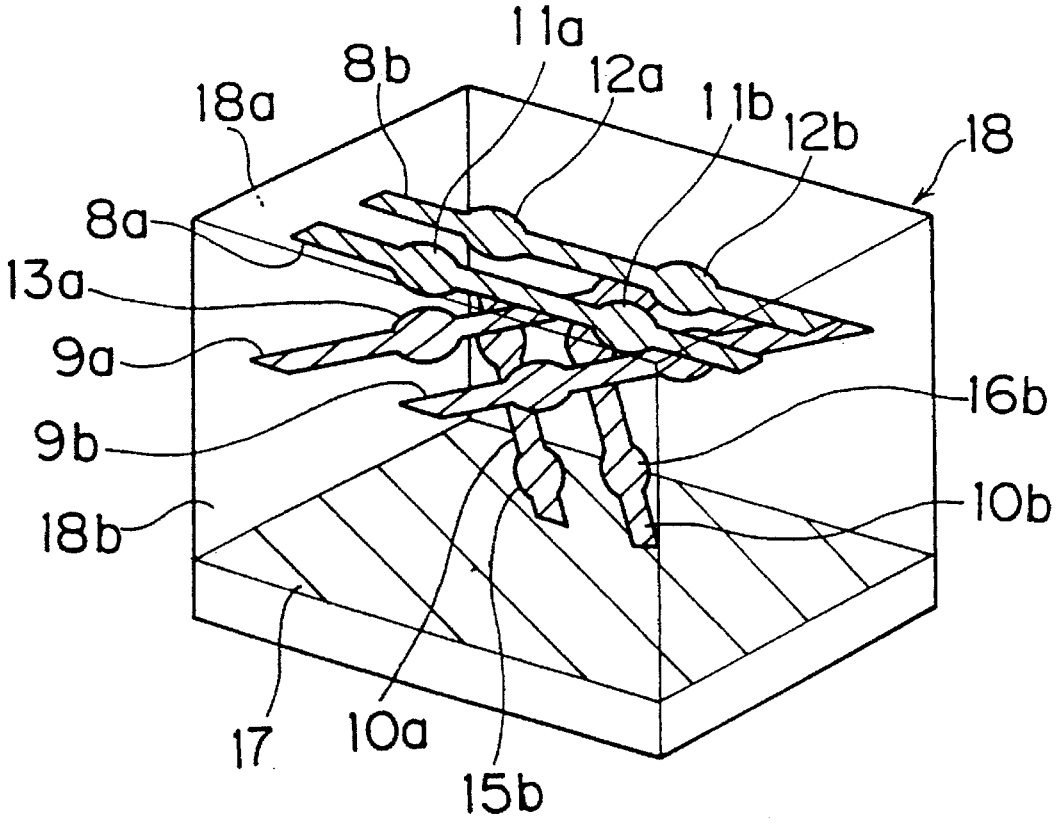
FIG. 3 is a perspective view for illustrating the high-frequency use non-reciprocal circuit element according to the first embodiment of the present invention.

As schematically shown in FIG. 3, external electrodes are thereafter formed on the sintered body 18 as obtained for electrically connecting first ends of the central electrodes 8*a* and 8*b* to 10*a* and 10*b* which are exposed on side surfaces 18*a* and 18*b* of the sintered body 18, for example, while other external electrodes for input/output terminals are formed on second ends of the central electrodes 8*a* to 10*b*. The external electrodes can be formed by applying conductive paste containing metal powder of Cu, Ag-Pd or Ag to end surfaces of the sintered body 18 and baking the same at a temperature of about 900° to 1100° C. Alternatively, the external electrodes may be formed by another conductive film forming method such as vapor deposition, sputtering or plating.

The high-frequency use non-reciprocal circuit element according to this embodiment can be obtained in the aforementioned manner.

It is possible to form a closed magnetic circuit by arranging permanent magnets on upper and lower portions of the high-frequency use non-reciprocal circuit element, i.e., the sintered body 18, and holding the permanent magnets by metal yokes for applying a dc magnetic field to the intersectional portion of the central electrodes 8*a* to 10*a*, thereby forming a non-reciprocal circuit device which is employed as a circulator or an isolator.

In the high-frequency use non-reciprocal circuit element according to this embodiment, as hereinabove described, the material layers which are formed by firing the magnetic green sheets 2 and 3 are adapted to electrically insulate the central electrodes 8*a* and 8*b* to 10*a* and 10*b* from each other, to arrange high-frequency magnetic layers on the intersectional portion of the central electrodes 8*a* and 8*b* to 10*a* and 10*b*, and to define material layers for forming the impedance-matching capacitance. Thus, it is possible to remarkably reduce the number of components which are required for forming the principal portion as compared with the conventional high-frequency use non-reciprocal circuit element.

Further, it is possible to simplify the assembling step while omitting complicated manual operations due to the aforementioned ceramic lamination/integral firing technique which is employed for preparing the sintered body 18. Thus, it is possible to provide a high-frequency use non-reciprocal circuit element which is excellent in reliability at a low cost, while coping with progress in miniaturization of such a high-frequency use non-reciprocal circuit element.

In addition, the capacitance for an impedance-matching circuit can be readily adjusted in this embodiment. The aforementioned electrodes 11*a* to 16*b* are integrally formed with the central electrodes 8*a* to 10*b* and hence the capacitance is derived through line capacities between the central electrodes 8*a* to 10*b*. In this case, it is possible to readily adjust the line capacities by properly changing the positions for forming the central electrodes 8*a* to 10*b*, the thicknesses of the magnetic green sheets 2 and 3, or areas of the electrodes 11*a* to 16*b*. Thus, it is possible to readily adjust the impedance-matching capacitance in a wide range.

Second Embodiment

Magnetic mixed powder containing yttrium oxide ($Y_2O_3$) and iron oxide ($Fe_2O_3$) in a weight ratio of 46:54 is calcined at a temperature of 800° to 1200° C., to prepare calcined powder.

The calcined powder as obtained is crushed and dispersed in an organic solvent with a polyvinyl alcohol binder, to prepare a magnetic slurry. The magnetic slurry as obtained is employed to form a magnetic green sheet having a uniform thickness of several 10 μm by a doctor blade coater, and this magnetic green sheet is punched into a rectangular plane shape of 40 mm by 20 mm.

Figure 4:
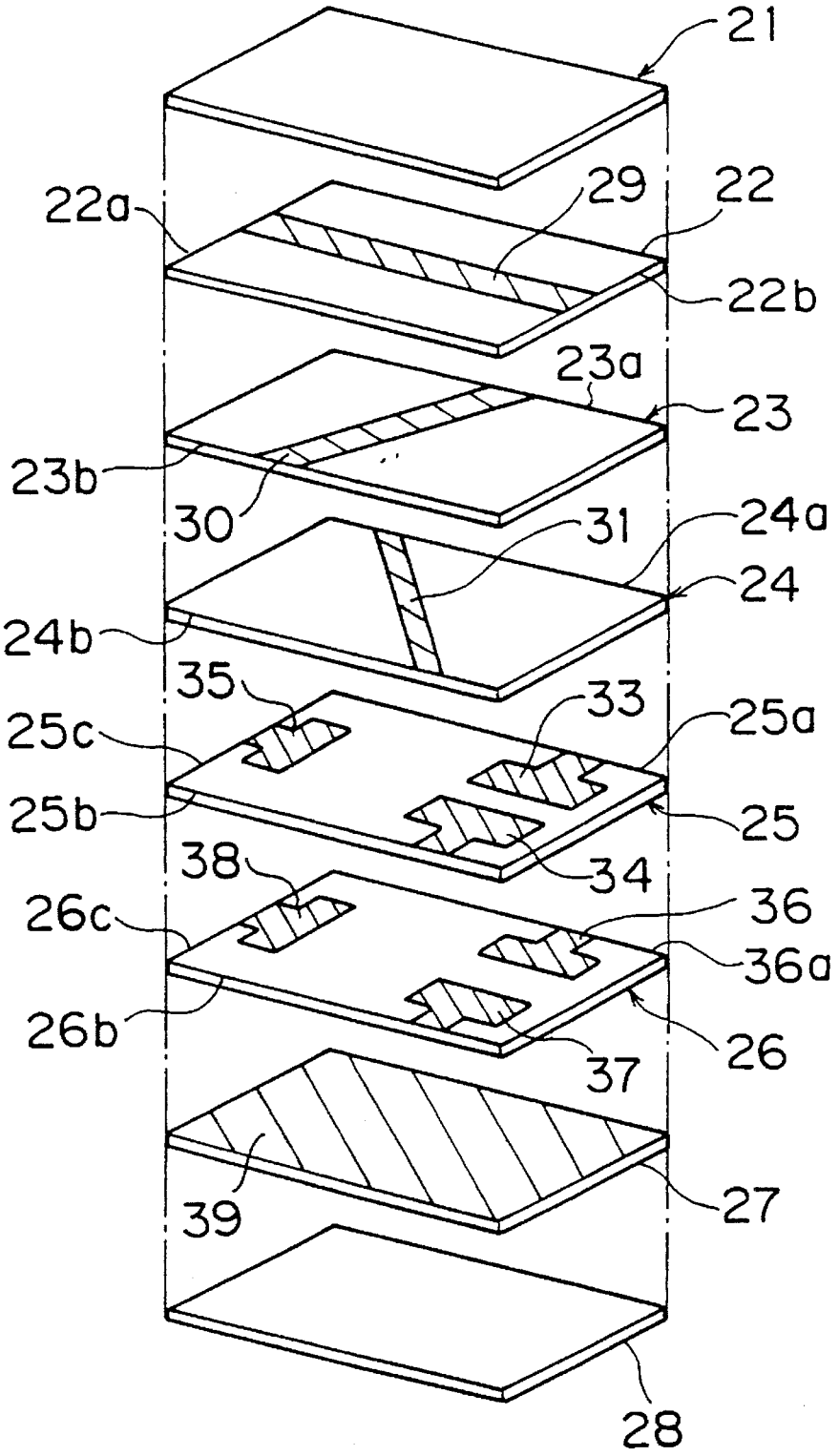
FIG. 4 is an exploded perspective view for illustrating magnetic green sheets employed for obtaining a microwave use non-reciprocal circuit element according to a second embodiment of the present invention and shapes of electrodes which are formed thereon.

A plurality of such punched magnetic green sheets are prepared so that conductive paste is screen-printed on single surfaces of parts of these green sheets as shown in FIG. 4, thereby forming central electrodes and internal electrodes for deriving capacitance.

In more concrete terms, a plurality of magnetic green sheets 21 to 28 are prepared in FIG. 4. A central electrode 29 is formed on an upper surface of the magnetic green sheet 22, to extend from one edge 22*a* toward another edge 22*b*. Further, central electrodes 30 and 31 are formed on upper surfaces of the magnetic green sheets 23 and 24 by printing conductive paste, to extend across side edges 23*a* and 23*b* and side surfaces 24*a* and 24*b* respectively.

The central electrodes 29 to 31 are arranged to be at angles of 120° to each other about an upper surface center of the magnetic green sheet 22 when the magnetic green sheets 22 to 24 are stacked with each other.

Internal electrodes 33 to 35 and 36 to 38 for forming capacitance for an impedance-matching circuit are formed on upper surfaces of the magnetic green sheets 25 and 26 respectively. The internal electrodes 33 and 36, 34 and 37, and 35 and 38 are formed to overlap with each other along the thickness direction through the magnetic green sheet 25 after stacking. Further, the internal electrodes 33 to 38 are drawn out toward side edges 25*a* and 25*b* and an edge 25*c* of the magnetic green sheet 25 as well as side edges 26*a* and 26*b* and an edge 26*c* of the magnetic green sheet 26 respectively.

An earth electrode 39 is formed on the overall upper surface of the magnetic green sheet 27.

The uppermost and lowermost magnetic green sheets 21 and 28 are provided with no electrodes.

Figure 5:
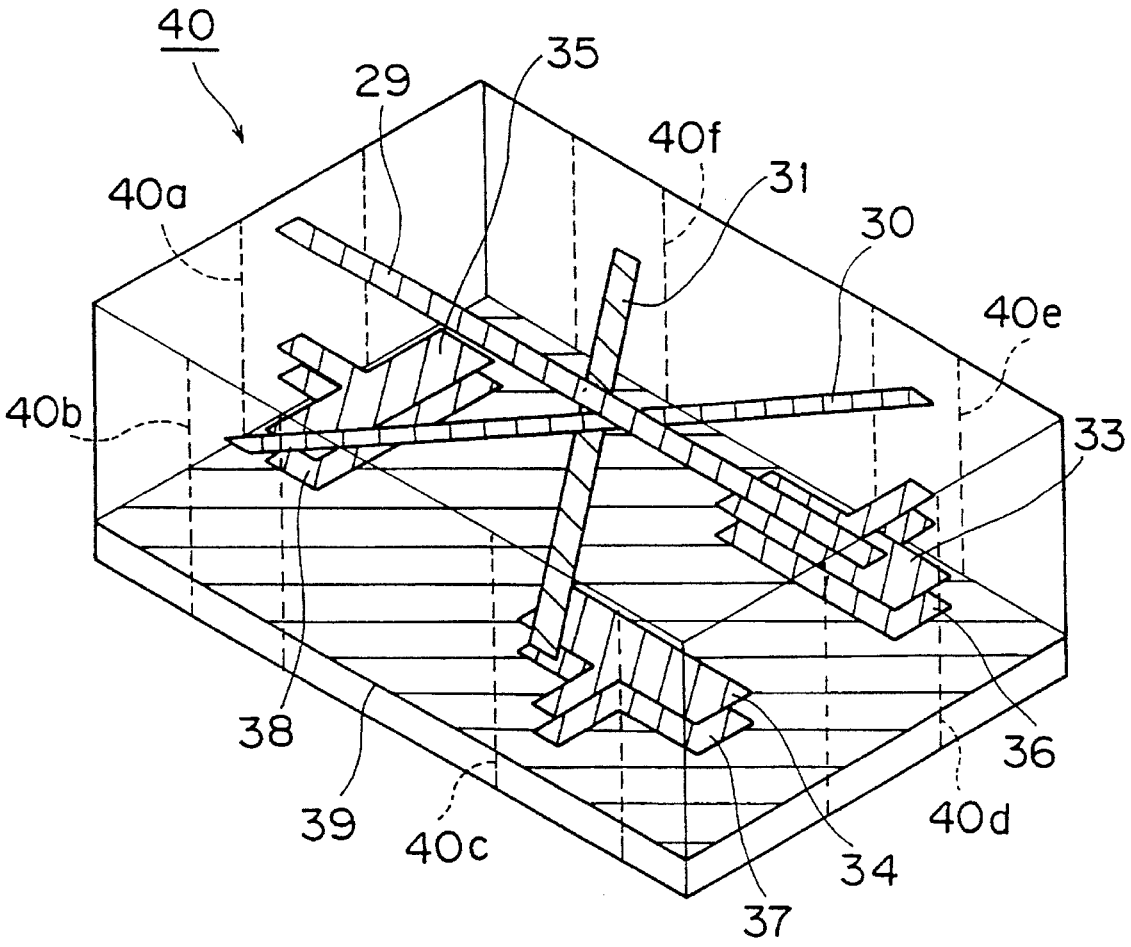
FIG. 5 is a perspective view for illustrating the microwave use non-reciprocal circuit element according to the second embodiment of the present invention.
Figure 6:
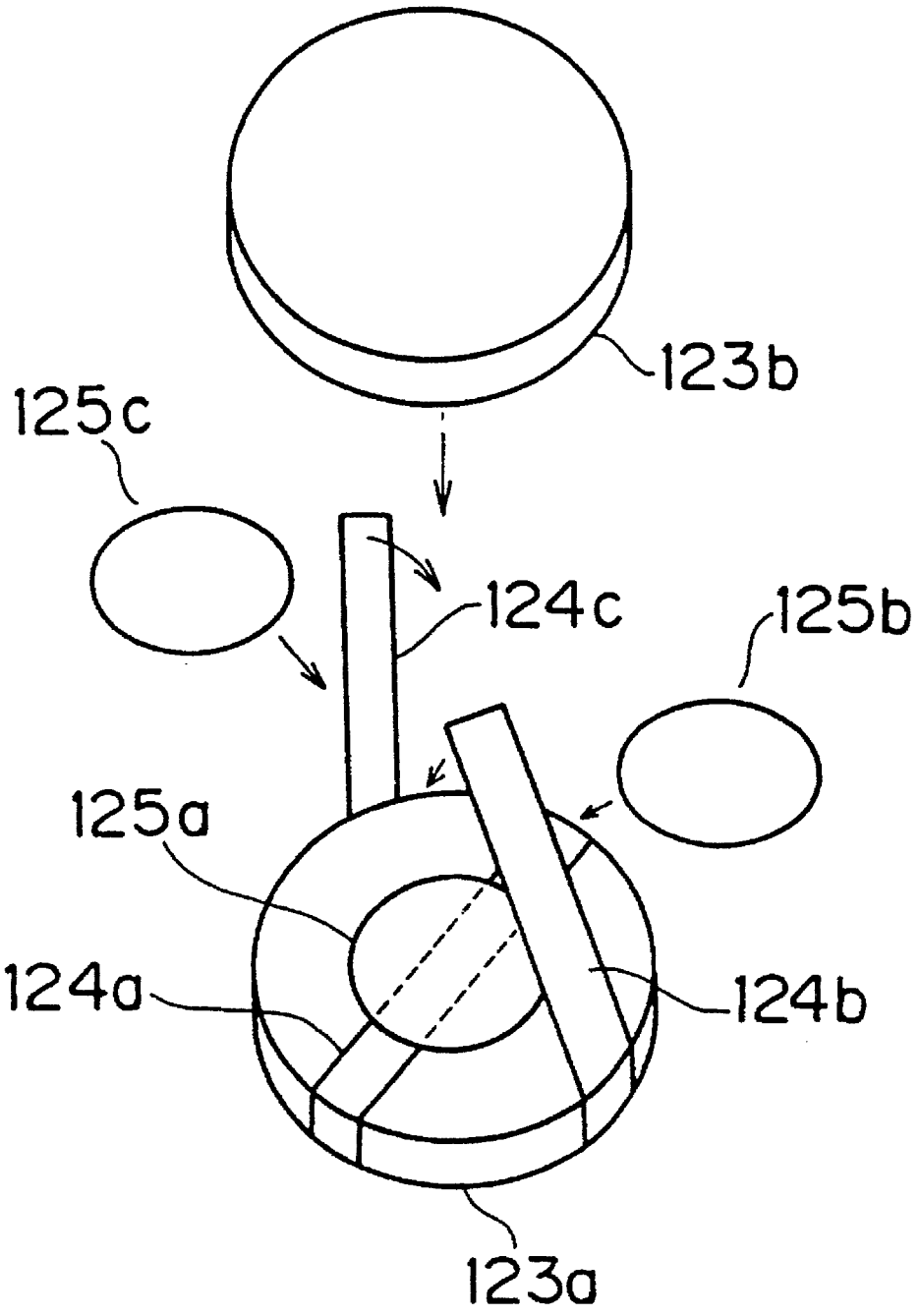
FIG. 6 PRIOR ART
FIG. 6 is a perspective view for illustrating steps of assembling a conventional high-frequency use non-reciprocal circuit element.
Figure 7:
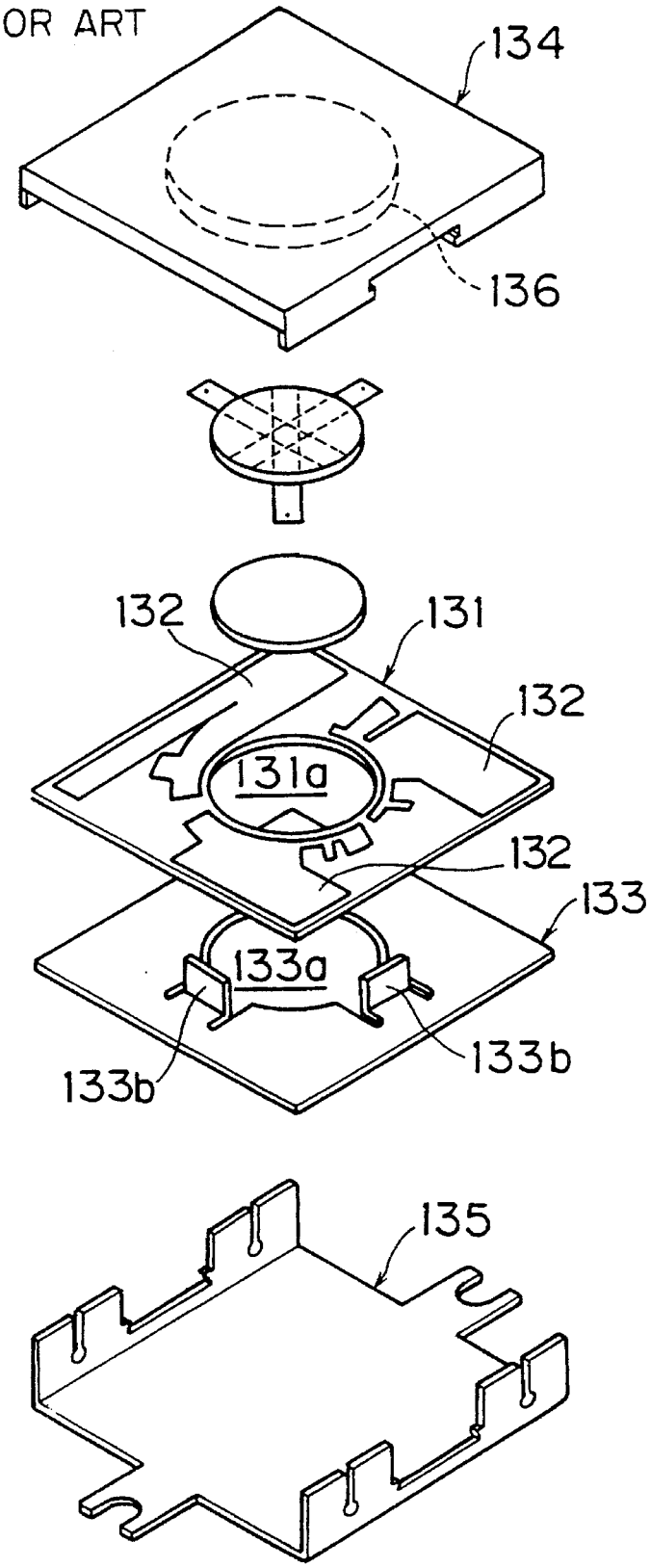
FIG. 7 PRIOR ART
FIG. 7 is an exploded perspective view for illustrating steps of assembling the conventional high-frequency use non-reciprocal circuit element.
Figure 8:
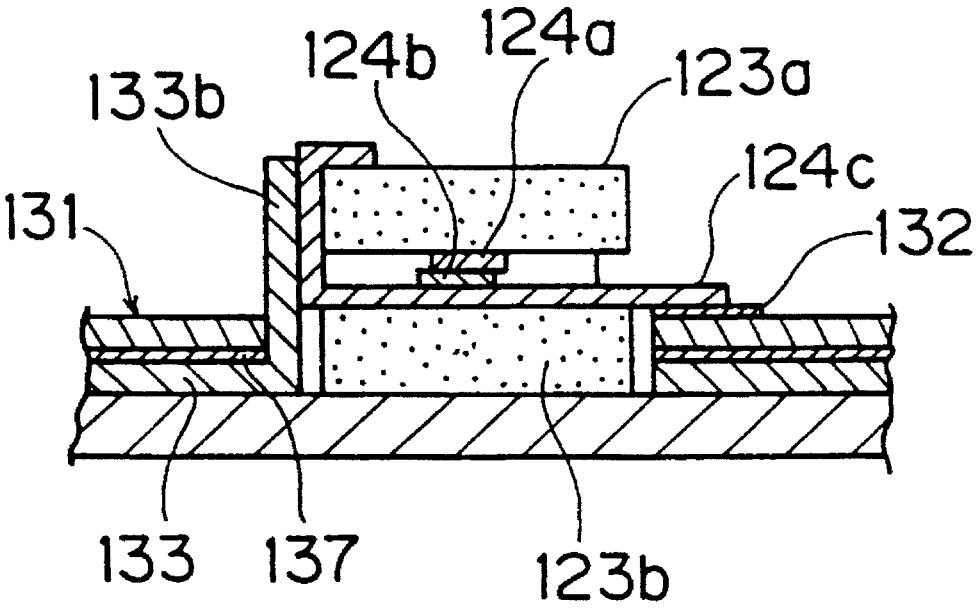
FIG. 8 PRIOR ART
FIG. 8 is a sectional view showing a principal part of the conventional high-frequency use non-reciprocal circuit element.

Then, the magnetic green sheets 21 to 28 shown in FIG. 4 are stacked with each other in the illustrated direction, and compression-bonded to each other along the thickness direction to obtain a laminate. The laminate as obtained is fired at a temperature of 1300° to 1500° C. to obtain a sintered body shown in FIG. 5, i.e., a microwave use magnetic body 40. In this microwave use magnetic body 40, the plurality of central electrodes 29 to 31 are formed on different vertical positions to intersect with each other while being electrically insulated from each other through magnetic layers, as shown in a perspective manner. In a portion lower than that provided with the central electrodes 29 to 31, the internal electrodes 33 to 35 and 36 to 38 are formed on different vertical positions. The aforementioned earth electrode 39 is formed on the overall surface of a plane which is downward beyond the internal electrodes 36 to 38.

Then, external electrodes 40*a* to 40*f* are formed on outer surfaces of the microwave use magnetic body 40. The external electrodes 40*a* to 40*f* can be formed by applying conductive paste containing metal powder of Cu, Ag-Pd or Ag and glass frit and baking the same at a temperature of about 900° to 1200° C. Alternatively, the external electrodes 40*a* to 40*f* may be formed by another conductive film forming method such as plating or sputtering. Further, the external electrode forming material is not restricted to the above but can be properly prepared from another conductive material.

It is possible to obtain a microwave use non-reciprocal circuit element according to the second embodiment of the present invention in the aforementioned manner. In this microwave use non-reciprocal circuit element, an end of the central electrode 29 is connected in common with the internal electrodes 35 and 38 and the earth electrode 39 by the external electrode 40*a*, while the other end thereof is electrically connected to the earth electrode 39 by the external electrode 40*d*. An end of the central electrode 30 is electrically connected to the earth electrode 39 by the external electrode 40*b*, while the other end thereof is electrically connected to the internal electrodes 33 and 36 and the earth electrode 39 by the external electrode 40*e*. Further, an end of the central electrode 31 is connected in common to the internal electrodes 34 and 37 and the earth electrode 39 by the external electrode 40*c*, while the other end thereof is electrically connected to the earth electrode 39 by the external electrode 40*f*.

Thus, it is possible to form a closed magnetic circuit by arranging permanent magnets on upper and lower portions of the microwave use non-reciprocal circuit element, i.e., the microwave use magnetic body 40, and holding the permanent magnets by metal yokes for applying a dc magnetic field to the intersectional portion of the central electrodes 29 to 31, thereby forming a non-reciprocal circuit device which is employable as a circulator or an isolator.

In the microwave use non-reciprocal circuit element according to the second embodiment, as hereinabove described, the plurality of central electrodes 29 to 31 are electrically insulated from each other by the magnetic layer of the microwave use magnetic body 40, while the capacitance derived from the internal electrodes 33 to 35 and 36 to 38 is also formed by the magnetic layer of the microwave use magnetic body 40. Thus, it is possible to remarkably reduce the number of components which are required for forming the principal part of the microwave use non-reciprocal circuit element as compared with a conventional microwave use non-reciprocal circuit element.

Further, it is possible to simplify the assembling step while omitting complicated manual operations due to the aforementioned ceramic lamination/integral firing technique which is employed for preparing the microwave use magnetic body 40. Thus, it is possible to provide a microwave use non-reciprocal circuit element which is excellent in reliability at a low cost, while coping with progress in miniaturization of such a microwave use non-reciprocal circuit element.

While each of the sintered body 18 and the microwave use magnetic body 40 is obtained by sintering a laminate which is prepared by stacking magnetic green sheets while interposing central electrodes in the first and second embodiments, the same may alternatively be obtained by repeating a series of steps of printing paste containing a magnetic substance on a base material such as a synthetic resin film, drying the same, thereafter printing conductive paste and drying the same thereby forming a laminate on the base material, and sintering the laminate.

It is not requisite to employ the doctor blade coater for forming the magnetic green sheets, but the magnetic green sheets may alternatively be prepared by another forming method such as extrusion molding.

While a plurality of central electrodes are formed on each magnetic green sheet in each of the embodiments shown in the drawings, only a single central electrode may alternatively be formed on each magnetic green sheet. Further, the central electrodes may be formed by gravure printing, for example, in place of screen printing.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A high-frequency use non-reciprocal circuit element comprising:

at least one insulator layer;

a plurality of central electrodes being separated through said insulator layer to be electrically insulated from each other while being arranged to intersect with each other;

a high-frequency use magnetic body being arranged on an intersectional portion of said central electrodes; and impedance-matching capacitance being connected to said central electrodes, a dc magnetic field being applied to said intersectional portion by a permanent magnet, said insulator layer and a dielectric portion for said impedance-matching capacitance being integrally formed by the same magnetic layer as said high-frequency use magnetic body, said high-frequency use non-reciprocal circuit element further comprising at least a pair of electrodes for deriving said impedance-matching capacitance, being formed to overlap with each other through said high-frequency use magnetic layer.

2. A high-frequency use non-reciprocal circuit element in accordance with claim 1, wherein said at least a pair of electrodes for deriving said impedance-matching capacitance are formed in series with at least a pair of said central electrodes in the vicinity of said intersectional portion of said plurality of central electrodes.

3. A high-frequency use non-reciprocal circuit element in accordance with claim 2, wherein said high-frequency use magnetic body is obtained by stacking unfired magnetic layers while interposing an electrode material therebetween and firing a raw magnetic chip as obtained, said plurality of central electrodes being formed at different vertical positions in said high-frequency use magnetic body.

4. A high-frequency use non-reciprocal circuit element in accordance with claim 3, wherein each of said central electrodes being formed in a respective said vertical position is formed by a plurality of electrodes in said high-frequency use magnetic body.

5. A high-frequency use non-reciprocal circuit element comprising:

at least one insulator layer;

a plurality of central electrodes being separated through said insulator layer to be electrically insulated from each other while being arranged to intersect with each other;

a high-frequency use magnetic body being arranged on an intersectional portion of said central electrodes; and impedance-matching capacitance being connected to said central electrodes, a dc magnetic field being applied to said intersectional portion by a permanent magnet, said insulator layer and a dielectric portion for said impedance-matching capacitance being integrally formed by the same magnetic layer as said high-frequency use magnetic body, said high-frequency use non-reciprocal circuit element further comprising at least a pair of electrodes for deriving said impedance-matching capacitance, being formed to overlap with each other through said high-frequency use magnetic layer; and further comprising an earth electrode being provided in a position separated from said central electrodes and said at least a pair of electrodes for deriving said impedance-matching capacitance through said magnetic layer.

6. A high-frequency use non-reciprocal circuit element comprising:

at least one insulator layer;

a plurality of central electrodes being separated through said insulator layer to be electrically insulated from each other while being arranged to intersect with each other;

a high-frequency use magnetic body being arranged on an intersectional portion of said central electrodes; and impedance-matching capacitance being connected to said central electrodes, a dc magnetic field being applied to said intersectional portion by a permanent magnet, said insulator layer and a dielectric portion for said impedance-matching capacitance being integrally formed by the same magnetic layer as said high-frequency use magnetic body, said high-frequency use non-reciprocal circuit element further comprising at least a pair of electrodes for deriving said impedance-matching capacitance, being formed to overlap with each other through said high-frequency use magnetic layer;

wherein said at least a pair of electrodes for deriving said impedance-matching capacitance are formed independently of said plurality of central electrodes.

7. A high-frequency use non-reciprocal circuit element in accordance with claim 6, wherein said high-frequency use magnetic body is obtained by stacking unfired magnetic layers while interposing an electrode material therebetween and firing a raw magnetic chip as obtained, said plurality of central electrodes being formed at different vertical positions in said high-frequency use magnetic body.

8. A high-frequency use non-reciprocal circuit element in accordance with claim 7, further comprising a plurality of external electrodes being formed on an outer surface of said high-frequency use magnetic body and electrically connected to said central electrodes and said electrodes for deriving said impedance-matching capacitance.

* * * * *